US007566126B2

(12) United States Patent
Ha et al.

(10) Patent No.: US 7,566,126 B2
(45) Date of Patent: Jul. 28, 2009

(54) ONE-MOLDING FRAME OF IMAGE FORMING APPARATUS

(75) Inventors: Dong-woo Ha, Suwon-si (KR); Karp-sik Youn, Hwaseong-gun (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 224 days.

(21) Appl. No.: 11/520,723

(22) Filed: Sep. 14, 2006

(65) Prior Publication Data

US 2007/0070096 A1 Mar. 29, 2007

(30) Foreign Application Priority Data

Sep. 28, 2005 (KR) ..... 10-2005-0090713

(51) Int. Cl.
*B41J 29/13* (2006.01)

(52) U.S. Cl. ..... 347/108; 347/104; 347/8

(58) Field of Classification Search ..... 347/108
See application file for complete search history.

(56) References Cited

U.S. PATENT DOCUMENTS 5,182,861 A 2/1993 Suzuki et al.
6,068,374 A * 5/2000 Kurata et al. ..... 347/108
6,488,371 B2 12/2002 Kosaka et al.
6,945,714 B2 * 9/2005 Miyauchi et al. ..... 400/55
7,399,130 B2 * 7/2008 Hirte et al. ..... 400/120.16

FOREIGN PATENT DOCUMENTS

KR 2004-10731 1/2004

* cited by examiner

*Primary Examiner*—Matthew Luu
*Assistant Examiner*—Brian J Goldberg
(74) *Attorney, Agent, or Firm*—Stanzione & Kim LLP

(57) ABSTRACT

A one-molding frame of an image forming apparatus includes a feeding part to feed sheets of paper one by one, a printing unit with a printing module provided along a paper feeding passage to form an image on the paper fed from the feeding module, and an ejecting unit with an ejecting module to eject and stack the paper after the printing unit forms the image on the paper. The printing module includes an array type inkjet head with a nozzle unit having a length corresponding to a width of the paper, and the printing unit includes at least one aligning mark to align the inkjet head. The one-molding frame improves an alignment precision between the one-molding frame and the inkjet head and a head gap precision between the inkjet head and the paper. Further, a manufacturing cost of the image forming apparatus can be reduced by employing the one-molding frame.

7 Claims, 5 Drawing Sheets

ONE-MOLDING FRAME OF IMAGE FORMING APPARATUS

CROSS-REFERENCE TO RELATED APPLICATIONS

This application claims the benefit of Korean Patent Application No. 10-2005-0090713, filed on Sep. 28, 2005, in the Korean Intellectual Property Office, the disclosure of which is incorporated herein in its entirety by reference.

BACKGROUND OF THE INVENTION

1. Field of the Invention

The present general inventive concept relates to a one-molding frame of an image forming apparatus, and more particularly, to a one-molding frame of an image forming apparatus with an array type inkjet head.

2. Description of the Related Art

An inkjet printer is a device for printing a color image on a printing medium such as paper or textile by ejecting droplets of ink onto a desired region of the printing medium.

A conventional inkjet printer usually includes an inkjet head that prints an image on a printing medium such as paper while reciprocating in a direction perpendicular to a feeding direction of the printing medium (i.e., the inkjet head moves in a width direction of the printing medium). The conventional inkjet printer is called an inkjet printer with a shuttle type inkjet head. However, the conventional inkjet printer with the shuttle type inkjet head which prints an image while reciprocating is disadvantageous because it prints images at a low speed, although the reciprocating inkjet head can print images at a high resolution.

Recently, an inkjet printer employing an inkjet head having a plurality of nozzles arranged along a width of the paper has been developed. In this type of inkjet printer, the inkjet head is kept in a fixed position without reciprocating movement while the inkjet head prints the image on the sheet of paper that is fed, thereby providing a high speed printing. The inkjet printer with the fixed inkjet head is called an array type inkjet printer.

The conventional array type inkjet printer is desirable to have a frame, in which various components of the inkjet printer, such as a paper feeding module, a printing module, and a paper ejecting module are installed and it is more desirable that the frame is made in one piece to reduce a manufacturing cost of the inkjet printer. That is, by introducing a one-piece (one-molding) frame into the conventional array type inkjet printer, a number of components required for the inkjet printer can be reduced and, thus, a number of assembling processes can be reduced.

To use the one-molding frame for the array type inkjet printer, the following points should be carefully considered. First, since the array type inkjet head is a consumable component with a limited lifespan, each time the inkjet head is replaced, a newly-installed inkjet head must be precisely aligned with the one-molding frame. Secondly, since the inkjet head is provided with nozzles to eject droplets of ink on the paper, a distance between the nozzles and the paper (a head gap) must be properly adjusted and constantly maintained while the inkjet head is operating, so as to eject the ink droplets precisely on the paper at a desired region.

SUMMARY OF THE INVENTION

The present general inventive concept provides a one-molding frame of an image forming apparatus, which is designed to reduce a number of components and assembling processes required to assemble the image forming apparatus and to reduce a manufacturing cost of the image forming apparatus.

The present general inventive concept also provides a one-molding frame of an image forming apparatus, which is designed to improve a horizontal position alignment precision of an inkjet head.

The present general inventive concept further provides a one-molding frame of an image forming apparatus, which is designed to improve a head gap precision between a printing medium and a nozzle unit of an inkjet head.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a feeding part installed with a feeding module to feed sheets of paper one by one, a printing unit installed with a printing module installed after the feeding module is installed along a paper feeding passage to form an image on the paper fed from the feeding module, and an ejecting unit installed with an ejecting module to eject and stack the paper after the printing unit forms the image on the paper. The printing module includes an array type inkjet head with a nozzle unit having a length corresponding to a width of the paper, and the printing unit includes at least one aligning mark to align the inkjet head.

The aligning mark may include a first aligning mark and a second aligning mark, and the inkjet head may include a third aligning mark formed at a position corresponding to the second aligning mark.

The printing unit may include an inkjet head support.

The inkjet head support may include a horizontal inkjet head supporting surface, and the first aligning mark may be formed on the horizontal inkjet head supporting surface to make contact with the nozzle unit.

The first aligning mark may have a predetermined height with respect to the inkjet head supporting surface of the printing unit, such that a predetermined head gap can be defined between the paper and the nozzle unit of the inkjet head.

The second aligning mark may be formed on a second inkjet head supporting surface of the printing unit in the vicinity of the first aligning mark. The second aligning mark and the third aligning mark may be formed such that the inkjet head and the printing unit are aligned when the second aligning mark and the third aligning mark are aligned.

The first aligning mark may have a stripe shape.

The second aligning mark may have a protrusion shape, and the third aligning mark may have a hole shape.

The second aligning mark may have a hole shape, and the third aligning mark may have a protrusion shape.

The foregoing and/or other aspects and utilities of the present general inventive concept may also be achieved by providing a one-molding frame usable in an image forming apparatus, including a base frame, a feeding part formed on a first portion of the base frame, and having a first plate to define a first opening to receive a printing medium, an exiting unit formed on a second portion of the base frame, and having a third plate to define a third opening to discharge the print medium, and a printing unit formed between the first and second portions, and having a second plate to define a second opening.

The foregoing and/or other aspects and utilities of the present general inventive concept may also be achieved by providing an image forming apparatus, including a monolithic frame having a feeding unit to receive a pickup roller, a printing unit to receive an inkjet head, a feed roller, and a paper guide, and an ejecting unit to receive an ejecting roller, and having first and second aligning marks defined thereon to position a nozzle unit of the printing unit vertically and horizontally, respectively, to a predetermined location with respect to a printing medium disposed on the paper guide.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
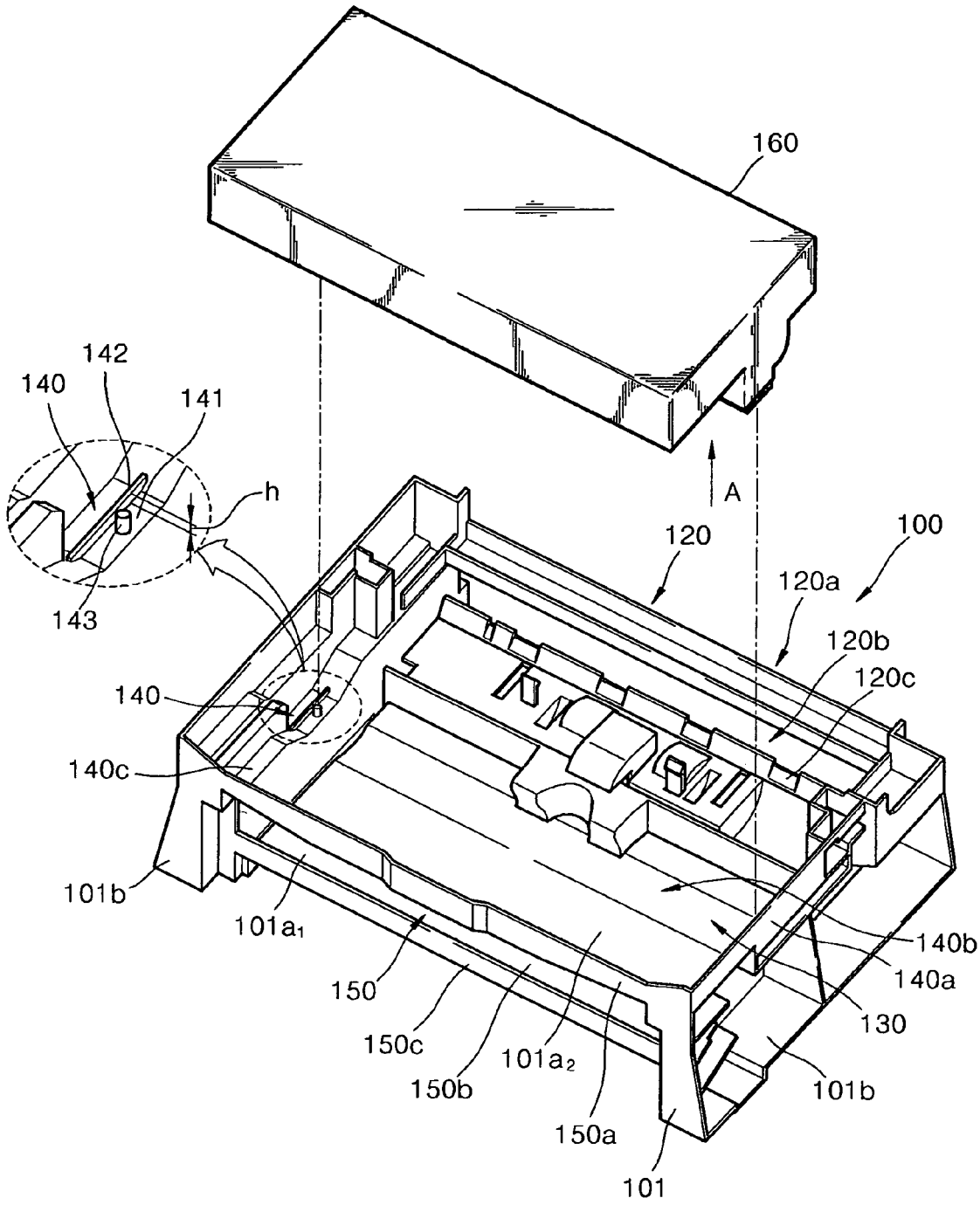
FIG. 1 is an exploded perspective view illustrating an installation of an array type inkjet head into a one-molding frame of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
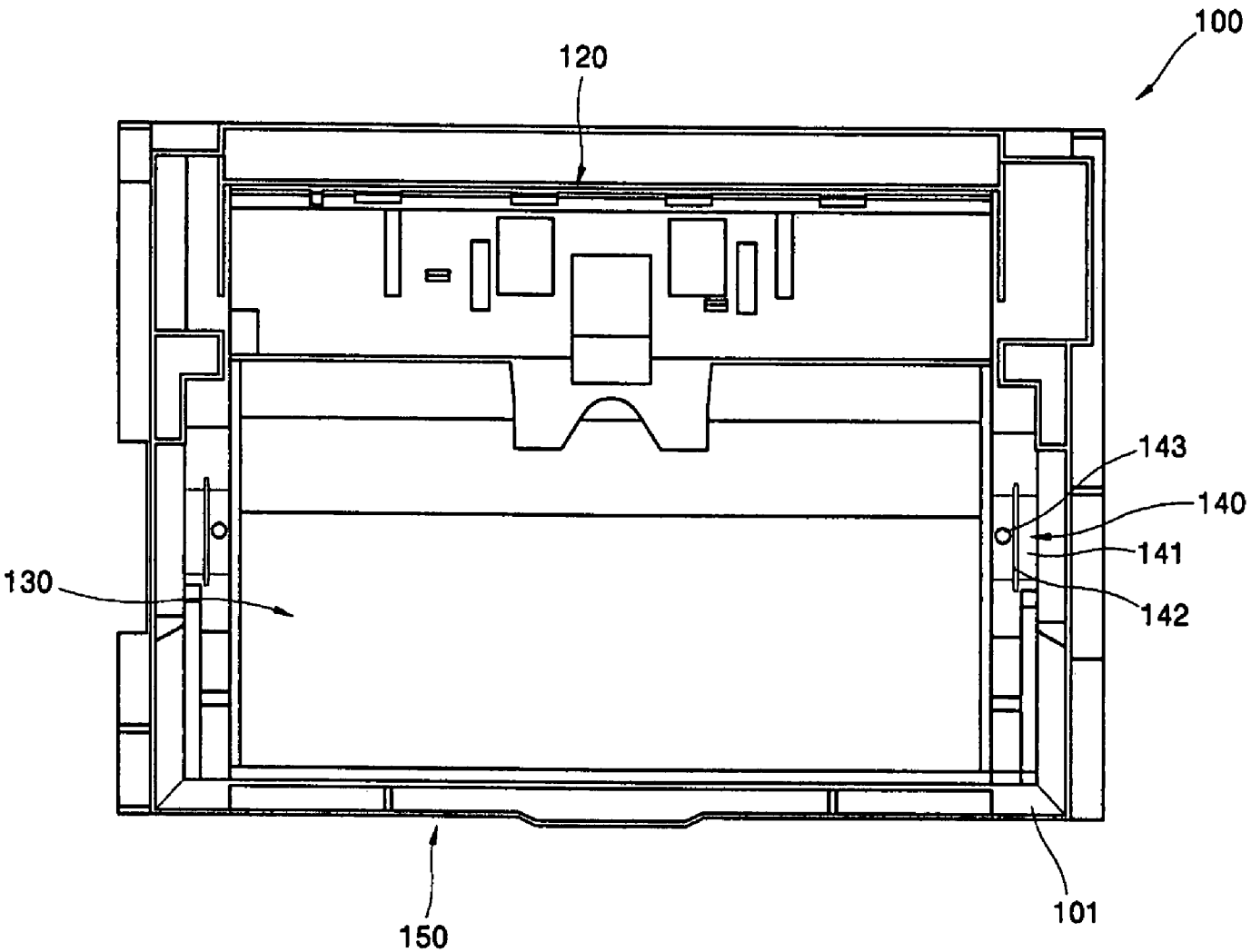
FIG. 2 is an enlarged plan view illustrating the one-molding frame of FIG. 1.

FIG. 1 is an exploded perspective view illustrating an installation of an array type inkjet head into a one-molding frame 100 of an image forming apparatus according to an embodiment of the present general inventive concept, and FIG. 2 is an enlarged plan view illustrating the one-molding frame 100 of FIG. 1.

Referring to FIGS. 1 and 2, the one-molding frame 100 of the image forming apparatus includes a base frame 101, a feeding part 120 formed on a first side of the base frame 101, a printing unit 130 formed on a second side of the base frame 101, and an ejecting unit 150 formed on a third side of the base frame 101. The second side may be disposed between the first side and the third side.

The base frame 101 functions as a base structure to place the image forming apparatus at a desired location, such that the image forming apparatus can be stably positioned to print or copy an image. Therefore, bottom surfaces of the base frame 101, such horizontal surfaces $\mathbf{101}a_1$ and $\mathbf{101}a_2$, may be flat. In the present embodiment, the base frame 101 includes two long legs or side supports 101*b* to support both ends of the horizontal surfaces $\mathbf{101}a_1$ and $\mathbf{101}a_2$. Further, the base frame 101 includes a paper conveying passage (not shown) above the horizontal surfaces $\mathbf{101}a_1$ and $\mathbf{101}a_2$ to smoothly convey paper (not shown) from the feeding part 120 to an outside of the image forming apparatus through the printing unit 160 and the ejecting unit 150.

The feeding part 120 is formed on an end of the base frame 101. A pick-up roller (not shown) is provided on the feeding part 120 to supply the paper stored in a cassette one by one to an area to correspond to the printing unit 130.

The printing unit 130 is installed after the feeding part 120 along the paper conveying passage. The printing unit 130 includes an inkjet head support 140 to receive an array type inkjet head 160 that is included in a printing module (not shown).

The inkjet head support 140 includes an inkjet head supporting surface 141, a vertical position aligning mark, and a horizontal position aligning mark. Hereinafter, the vertical position aligning mark will be referred to as a first aligning mark 142, and the horizontal position aligning mark will be referred to as a second aligning mark 143. The first and second aligning marks 142 and 143 are formed on the inkjet head supporting surface 141. The first aligning mark 142 may have a stripe shape with a predetermined thickness, and the second aligning mark 143 has a protrusion shape. The first and second aligning marks 142 and 143 will be described later.

The printing unit 130 receives the inkjet print head 160 and a feeding roller (not shown). The feeding roller feeds the paper conveyed from the feeding part 120 such that the paper can pass directly under the inkjet head 160 at a regular interval.

The inkjet head 160 is provided with nozzle units (not shown) to eject ink onto the paper. The nozzle units are arranged such that when paper passes directly under the inkjet head 160, the nozzle units face one side of the paper while maintaining a predetermined distance from the one side of the paper. The predetermined distance between the nozzle units and the paper is called a "head gap." The head gap may be properly adjusted such that the ink ejected from the nozzle units can reach the paper at a desired position without scattering. The head gap can be adjusted by the first aligning mark 142, which positions the inkjet head 160 in the vertical direction. Since a surface 160*a* (illustrated in FIG. 3) of the inkjet head 160 where the nozzle units are formed makes contact with the first aligning mark 142, the surface 160*a* can be spaced a predetermined distance from the paper by adjusting a height h of the first aligning mark 142 that is protruded from the inkjet head supporting surface 141. The height h may be adjusted by adjusting a thickness of the first aligning mark 142. In other words, the head gap can be determined by adjusting the height h of the first aligning mark 142.

Further, a paper guide (170 of FIG. 4A) which supports the paper is formed above the horizontal surface $\mathbf{101}a_2$ of the base frame 101 that faces the nozzle units of the inkjet heat 160.

Figure 4A:
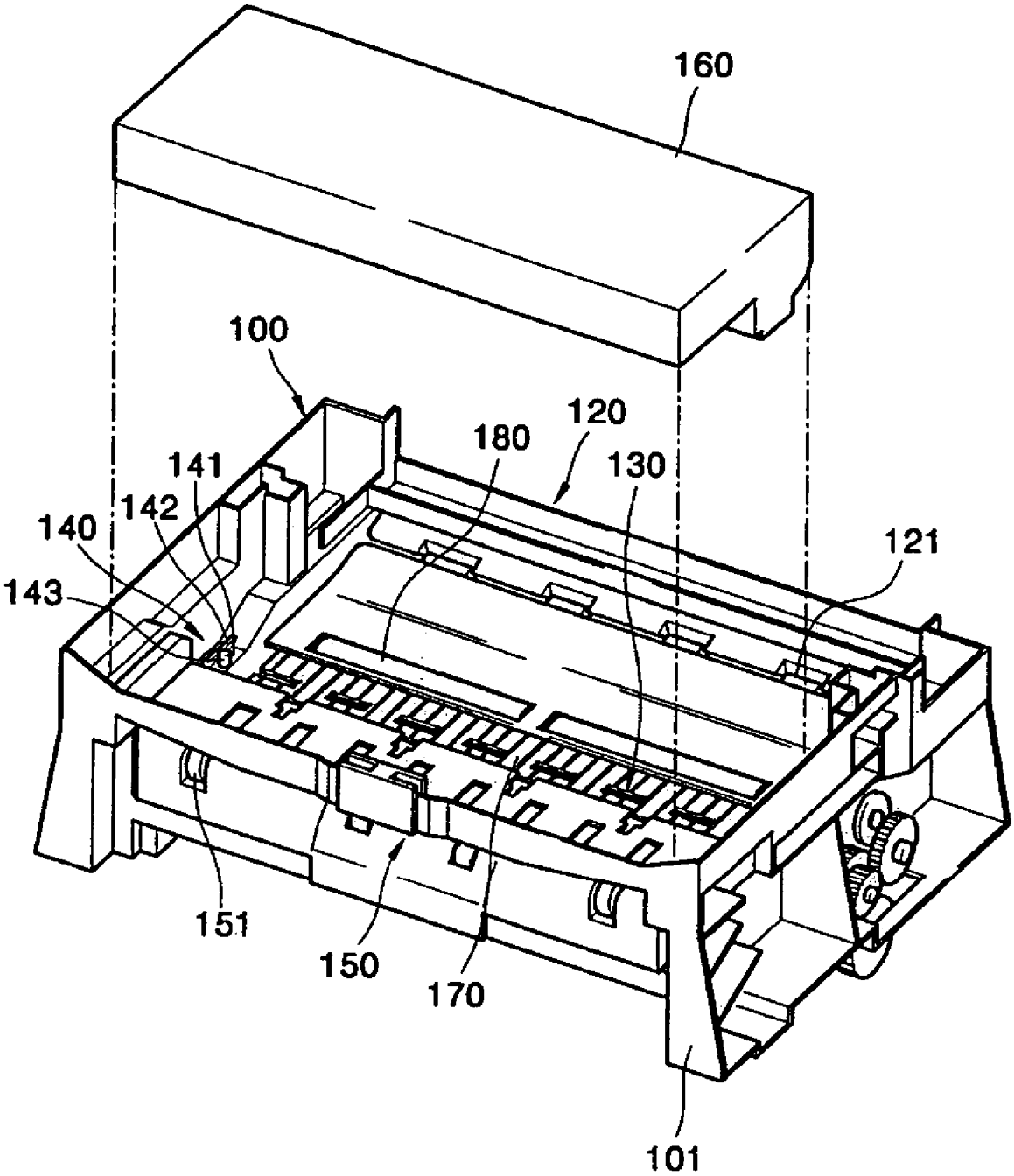
FIGS. 4A and 4B are perspective views illustrating installations of a paper feeding component, a printing component, and a paper ejecting component into the one-molding frame of FIG. 1, when the array type inkjet head is separated, and when all the components thereof are installed into the one-molding frame, respectively.

The ejecting unit 150 may receive an ejecting module (or an ejecting roller 151 of FIG. 4A). The paper on which the image is printed at the printing unit 130 is ejected by the ejecting module and stacked thereon.

Meanwhile, though not shown in the present embodiment, the one-molding frame 100 may be formed with a scanning unit and/or a maintenance unit.

The scanning unit, a portion of the one-molding frame 100, receives a scanning module (not shown). The scanning module includes a scanning sensor (not shown) to read images from originals, an ADF roller (not shown) to pick up the originals, and a white roller (not shown) to convey the originals.

The maintenance unit, a portion of the one-molding frame 100, receives a maintenance module (not shown). After printing, the maintenance module cleans the surface 160*a* of the inkjet head 160 where the nozzle units are formed, and when printing is not carried out, the maintenance module covers the nozzle units of the inkjet head 160 to prevent the ink from drying and sticking.

The feeding part 120 of the one molding frame 100 includes a plate 120*a* disposed between the side supports 101*b* to define an opening 120*b* of a paper passage of the paper, and a structure 120*c* on which the pickup roller 121 is placed. The printing unit 130 of the one molding frame 100 includes a plate 140*a* to define an opening 140*b* to receive a feeding roller 180, and a structure 140*c*. The inkjet head 160 is placed on the structure 140*c* on which the inkjet head 160 and paper guide are installed. The ejecting unit 150 of the one molding frame 100 includes a plate 150*a* to define an opening 150*b* of the paper passage of the paper, and a structure 150*c* on which an ejecting roller 151 is installed. The base frame 101 may be a part of the structures 120*c*, 140*c*, and 150*c*.

Figure 3:
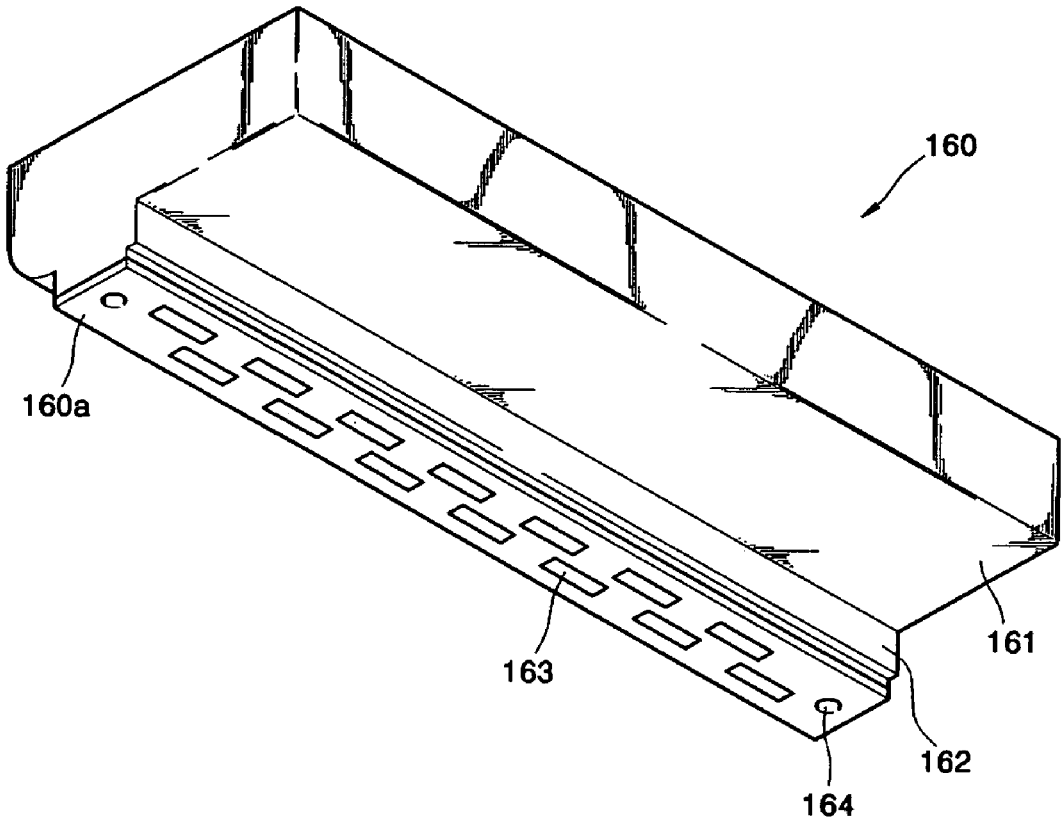
FIG. 3 is a perspective view illustrating an inkjet, viewed from a direction of an arrow A of FIG. 1.

FIG. 3 is a perspective view illustrating the inkjet head 160 of FIG. 1, viewed from a direction of an arrow A in FIG. 1.

Referring to FIG. 3, the array type inkjet head 160 includes a body 161, a projected portion 162, and a third aligning mark 164.

The projected portion 162 is elevated from the body 161. The projection portion 162 includes an end that is substantially parallel to the body 161. In the parallel end, nozzle units 163 are formed to have a length corresponding to a width of the paper.

The third aligning mark 164 is formed on each side of the parallel end of the projection portion 162 where the nozzle units 163 are not formed. The inkjet head 160 and the printing unit 130 can be aligned by aligning the third aligning mark 164 with the second aligning mark 143.

That is, the third aligning mark 164 corresponds to the second aligning mark 143. When the second aligning mark 143 has a protrusion shape as in this embodiment, the third aligning mark 164 may have a hole shape. If the second aligning mark 143 has a hole shape, then the third aligning mark 164 can have a protrusion shape. That is, the second aligning mark 143 and the third aligning mark 164 may be shaped so that they engage with each other. It is possible that the printhead 160 may have a slit to receive the first aligning mark 142.

Therefore, when the inkjet head 160 is replaced with a new one, the new inkjet head 160 can be precisely aligned with the printing unit 130 of the one-molding frame 100. That is, the new one can be precisely aligned with the inkjet head support 140. As a result, misalignment can be prevented when the inkjet head 160 is replaced with new one.

Figure 4B:
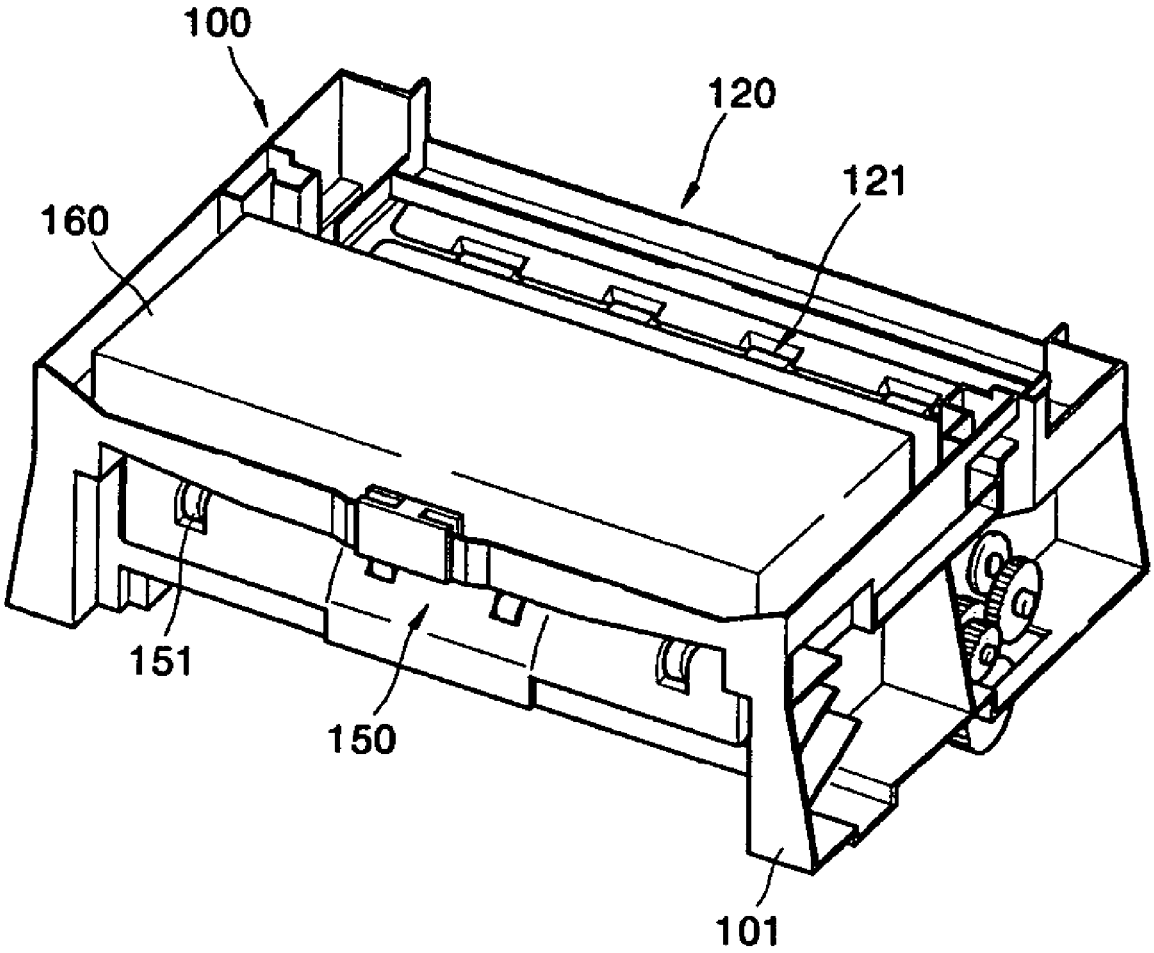

FIGS. 4A and 4B are perspective views illustrating installations of a paper feeding component, a printing component, and a paper ejecting component into the one-molding frame of FIG. 1. FIG. 4A illustrates the one-molding frame when the array type inkjet head is separated. FIG. 4B illustrates the one-molding frame when all the components are installed into the one-molding frame.

Referring to FIGS. 4A and 4B, a pick-up roller 121 is mounted on the structure 120*c* to be assembled with the feeding part 120. The paper passes through the opening 120*b* to be fed to the printing part 130 by the pickup roller 121.

A feeding roller 180, a paper guide 170, and the inkjet head 160 are assembled with the printing unit 130. The feeding roller 180 and the paper guide 170 are mounted on the horizontal surface 101$a_2$. The inkjet head 160 is mounted on the structure 140*c* and the inkjet head support 140. A paper passage of the paper is formed between the inkjet head 160 and the paper guide 170, and the paper is fed to the feed roller 180 to the ejecting unit 150.

An ejecting roller 151 is assembled with the ejecting unit 150. The ejecting roller 151 is mounted on the horizontal surface 101$a_1$ and the structure 150*c* to feed the paper through the opening 150*b* defined by the plate 150*a*.

Further, though not shown, a scanning module and a maintenance module, as described above, may be assembled into the one-molding frame 100.

In the image forming apparatus employing the one-molding frame 100 according to the embodiment of the present general inventive concept, the pick-up roller 121 is assembled with the feeding part 120 of the feeding module to supply paper one by one. The feeding roller 180, the paper guide 170, and the inkjet head 160 provide form the image on the paper. The ejecting roller 151 ejects and stacks the paper after the printing unit 130 prints the image on the paper.

As described above, frames to mount a feeding module, a printing module, and an ejecting module are integrally formed with a one-molding frame 100, so that it is not necessary to make separate frames. Therefore, a material cost is reduced. Further, an assembling cost is reduced since it is not required to assemble each module using a separate assembly line and assemble the resultant assembly to the base frame.

As described above, a number of components and processes required to manufacture an image forming apparatus is reduced, and thus an overall manufacturing cost of the image forming apparatus is reduced.

As described above, according to the present general inventive concept, the one-molding frame is formed with the horizontal position aligning mark to align the inkjet head, thereby providing an improved horizontal position alignment for the inkjet head.

As described above, according to the present general inventive concept, a one-molding frame is formed with a vertical position aligning mark to align an inkjet head, so that a head gap between the inkjet head and nozzle units can be adjusted more precisely.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A one-molding frame of an image forming apparatus, comprising:

a feeding part installed with a feeding module to feed sheets of paper one by one;

a printing unit installed with a printing module installed along a paper feeding passage to form an image on the paper fed from the feeding module; and an ejecting unit installed with an ejecting module to eject and stack the paper after the printing unit forms the image on the paper, wherein the printing module comprises an array type inkjet head with a nozzle unit having a length corresponding to a width of the paper, and the printing unit comprises a first aligning mark contacting a surface of the array inkjet head where the nozzle unit is formed when the array inkjet head is installed in the printing unit such that the nozzle unit faces one side of the paper while maintaining a predetermined head gap from the one side of the paper.

2. The one-molding frame of claim 1, wherein the printing unit comprises a second aligning mark, and the inkjet head comprises a third aligning mark formed at a position corresponding to the second aligning mark.

3. The one-molding frame of claim 1, wherein the first aligning mark has a stripe shape.

4. The one-molding frame of claim 1, wherein the first aligning mark has a predetermined height with respect to an inkjet head supporting surface of the printing unit, such that the predetermined head gap can be defined between the nozzle unit of the inkjet head and the paper.

5. The one-molding frame of claim 2, wherein the second aligning mark is formed on an inkjet head supporting surface of the printing unit in the vicinity of the first aligning mark, and the second aligning mark and the third aligning mark are formed such that the inkjet head and the printing unit are aligned when the second aligning mark and the third aligning mark are aligned.

6. The one-molding frame of claim 2, wherein the second aligning mark has a protrusion shape, and the third aligning mark has a hole shape.

7. The one-molding frame of claim 2, wherein the second aligning mark has a hole shape, and the third aligning mark has a protrusion shape.

* * * * *